United States Patent [19]

Arakawa et al.

[11] Patent Number: 4,800,136

[45] Date of Patent: Jan. 24, 1989

[54] RADIATION IMAGE STORAGE PANEL

[75] Inventors: Satoshi Arakawa; Junji Miyahara; Kenji Takahashi, all of Kaisei, Japan

[73] Assignee: Fuji Photo Film Co., Ltd., Japan

[21] Appl. No.: 49,024

[22] Filed: May 13, 1987

Related U.S. Application Data

[63] Continuation of Ser. No. 803,772, Nov. 28, 1985, abandoned, which is a continuation of Ser. No. 586,707, Mar. 6, 1984, abandoned.

[30] Foreign Application Priority Data

Mar. 7, 1983 [JP] Japan ..... 58-37837

[51] Int. Cl.[4] ..... G03C 5/16

[52] U.S. Cl. ..... 428/690; 428/691; 250/486.1; 250/484.1

[58] Field of Search ..... 428/690, 691, 917; 250/486.1, 484.1, 327.2

[56] References Cited

U.S. PATENT DOCUMENTS

| | | | |
|---|---|---|---|
| 3,107,178 | 10/1963 | Rindome | 428/690 X |
| 3,294,569 | 12/1966 | Messineo et al. | 428/690 X |
| 4,054,799 | 10/1977 | Wolfe et al. | 428/691 X |
| 4,336,154 | 6/1982 | Nishimura et al. | 250/327.2 X |
| 4,350,893 | 9/1982 | Takahashi et al. | 250/327.2 X |
| 4,380,702 | 4/1983 | Takahashi et al. | 250/484.1 X |
| 4,394,581 | 7/1983 | Takahashi et al. | 250/486.1 X |
| 4,415,471 | 11/1983 | Degenhardt | 428/691 X |

*Primary Examiner*—Nancy A. B. Swisher

*Attorney, Agent, or Firm*—Gerald J. Ferguson, Jr.

[57] ABSTRACT

A radiation image storage panel comprising a support and phosphor layers provided thereon which comprises a binder and a stimulable phosphor dispersed therein, characterized in that said phosphor layer include at least two layers of the first phosphor layer provided on the support and the second phosphor layer provided on the side nearer to the front surface of the panel than said first phosphor layer, and that the mixing ratio of the binder to the stimulable phosphor in the first phosphor layer is larger than the mixing ratio of the binder to the stimulable phosphor in the second phosphor layer.

9 Claims, 1 Drawing Sheet

RADIATION IMAGE STORAGE PANEL

This application is a continuation of Ser. No. 803,772 filed Nov. 28, 1985 now abandoned, which is a continuation of Ser. No. 586,707 filed Mar. 6, 1984 now abandoned.

BACKGROUND OF THE INVENTION

1. Field of the Invention

This invention relates to a radiation image storage panel and more particularly, to a radiation image storage panel comprising a support and phosphor layers provided thereon which comprise a binder and a stimulable phosphor dispersed therein.

2. Description of Prior Arts

For obtaining a radiation image, there has been conventionally employed a radiography utilizing a combination of a radiographic film having an emulsion layer containing a photosensitive silver salt material and a radiographic intensifying screen.

As a method replacing the above-described radiography, a radiation image recording and reproducing method utilizing a stimulable phosphor as described, for instance, in U.S. Pat. No. 4,239,968, has been recently paid much attention. In the radiation image recording and reproducing method, a radiation image storage panel comprising a stimulable phosphor (i.e., stimulable phosphor sheet) is used, and the method involves steps of causing the stimulable phosphor of the panel to absorb radiation energy having passed through an object or having radiated from an object; exciting the stimulable phosphor with an electromagnetic wave such as visible light and infrared rays (hereinafter referred to as "stimulating rays") to sequentially release the radiation energy stored in the stimulable phosphor as light emission (stimulated emission); photoelectrically converting the emitted light to electric signals; and reproducing the electric signals as a visible image on a recording material such as a photosensitive film or on a displaying device such as CRT.

In the above-described radiation image recording and reproducing method, a radiation image can be obtained with a sufficient amount of information by applying a radiation to the object at considerably smaller dose, as compared with the case of using the conventional radiography. Accordingly, this radiation image recording and reproducing method is of great value especially when the method is used for medical diagnosis.

The radiation image storage panel employed in the above-described radiation image recording and reproducing method has a basic structure comprising a support and a phosphor layer provided on one surface of the support. Further, a transparent film is generally provided on the free surface (surface not facing the support) of the phosphor layer to keep the phosphor layer from chemical deterioration or physical shock.

The phosphor layer comprises a binder and stimulable phosphor particles dispersed therein. The stimulable phosphor emits light (stimulated emission) when excited with stimulating rays after having been exposed to a radiation such as X-rays. In the radiation image recording and reproducing method, the radiation having passed through an object or having radiated from an object is absorbed by the phosphor layer of the radiation image storage panel in proportion to the applied radiation dose, and a radiation image of the object is recorded on the radiation image storage panel in the form of a radiation energy-stored image (latent image). The radiation energy-stored image can be released as stimulated emission by applying stimulating rays to the panel, for instance, by scanning the panel with stimulating rays. The stimulated emission is then photoelectrically converted to electric signals, so as to produce a visible image from the radiation energy-stored image.

It is desired for the radiation image storage panel employed in the radiation image recording and reproducing method to provide an image of high quality (high sharpness, high graininess, etc.).

In the conventional radiography the sharpness of the image depends on the spread of the emitted light (spontaneous emission) within a radiographic intensifying screen. The sharpness of the image in the radiation image recording and reproducing method utilizing a stimulable phosphor, in contrast to the conventional radiography, does not generally depend on the spread of the light (stimulated emission) emitted by the stimulable phosphor within the radiation image storage panel, but on the spread of stimulating rays therewithin. The reason can be described as follows. The radiation energy-stored image recorded on the radiation image storage panel is sequentially detected, since the stimulated emission given upon excitation with the stimulating rays for a certain period of time is detected as an output from the area of the panel to be excited therewith for said period. When the stimulating rays are spread through scattering or relfection within the panel, the stimulated emission from the area wider than the area to be excited is detected as the output therefrom.

A radiation image storage panel generally tends to provide an image of decreased sharpness, as the mixing ratio of a binder to a stimulable phosphor in a phosphor layer of the panel increases, in other words, as the amount of the stimulable phosphor contained in the phosphor layer decreases.

The radiation image storage panel is also required to have sufficient mechanical strength so as not to allow easy separation of the phosphor layer from the support, even if mechanical shocks and mechanical force in falling or bending are applied to the panel in the use. Further, since the radiation image storage panel hardly deteriorates upon exposure to a radiation and an electromagnetic wave ranging from visible light to infrared rays, the panel can be employed repeatedly for a long period. Accordingly, it is required for the panel in the repeated use not to cause such troubles as the separation of the phosphor layer from the support induced by mechanical shocks applied in the handling of radiation image storage panel in a step of exposure to a radiation, in a step of visualization of a radiation image brought about by excitation with an electromagnetic wave after the exposure to the radiation, or in a step of erasure of the radiation image information remaining in the panel.

However, the radiation image storage panel has a tendency that the bonding strength between the support and the phosphor layer of the panel decreases as the mixing ratio of the binder to the stimulable phosphor in the phosphor layer adjacent to the support decreases, in other words, as the amount of the stimulable phosphor contained therein increases.

For these reasons, it is difficult to prepare a composition for the preparation of the phosphor layer of the radiation image storage panel so as to satisfy both of the bonding strength between the support and the phosphor layer and the sharpness of the image provided thereby. In the conventional radiation image storage panel having a single phosphor layer, a radiation image storage panel capable of providing an image of high quality as well as showing a preferable bonding strength between the support and the phosphor layer is hardly obtained.

SUMMARY OF THE INVENTION

It is an object of the present invention to provide a radiation image storage panel having the characteristics to give an image of high sharpness as well as to show the high mechanical strength, especially the high bonding strength between the phosphor layer and the support.

The object is accomplished by the radiation image storage panel of the present invention comprising a support and phosphor layers provided thereon which comprise a binder and a stimulable phosphor dispersed therein, characterized in that said phosphor layers include at least two layers of the first phosphor layer provided on the support and the second phosphor layer provided on the side nearer to the front surface of the panel than said first phosphor layer, and that the mixing ratio of the binder to the stimulable phosphor in the first phosphor layer is larger than the mixing ratio of the binder to the stimulable phosphor in the second phosphor layer.

In the present invention, the mixing ratio of the binder to the stimulable phosphor in the phosphor layer means a mixing ratio represented by "amount of binder-/amount of stimulable phosphor", by weight. The front surface of the radiation image storage panel means a surface opposite to the support-side surface of the panel, namely, a surface of the top layer of plural phosphor layers or a surface of a protective film in the case that a protective film is provided on the plural phosphor layers.

DETAILED DESCRIPTION OF THE INVENTION

Figure 1:
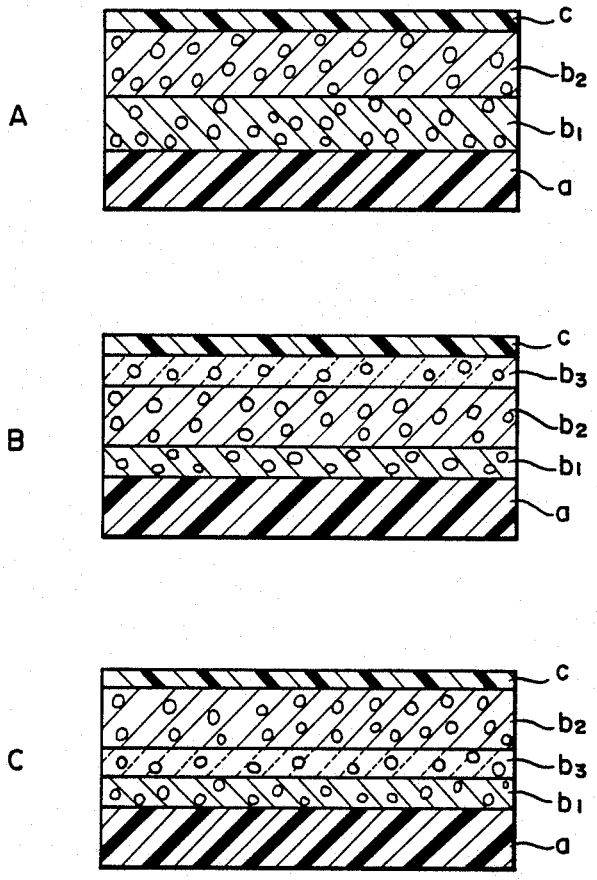
FIG. 1 schematically shows sectional views of the embodiments of the radiation image storage panels according to the present invention.

The radiation image storage panel of the present invention can be enhanced in both the sharpness of an image provided thereby and the bonding strength between the support and the phosphor layers thereof, by providing at least two phosphor layers and making the mixing ratio of the binder to the stimulable phosphor in the first phosphor layer provided on the support larger than the same mixing ratio in the second phosphor layer provided on the upper side of the first phosphor layer.

More in detail, the bonding strength between the support and the phosphor layers can be extremely enhanced by providing on the support a phosphor layer (the first phosphor layer) having a large mixing ratio of the binder to the stimulable phosphor. In general, as the bonding strength between the support and the phosphor layer in the radiation image storage panel, a peel strength (peel angle: 90° ) of not less than 200 g/cm is required in practical use. The present invention can provide a radiation image storage panel having such a high bonding strength.

The second phosphor layer of the radiation image storage panel according to the present invention, as described above, is provided on the side nearer to the front surface of the panel than the first phosphor layer (i.e., on side from which the emitted light is read out), and the mixing ratio of the binder to the stimulable phosphor in the second phosphor layer is adjusted to be smaller than that in the first phosphor layer, whereby the image having a high sharpness can be obtained. The thickness of the second phosphor layer of the panel according to the present invention is preferably larger than that of the first phosphor layer, and particularly preferable is not less than 50% of the total thickness of the phosphor layers.

Further, the present invention provides a radiation image storage panel in which the first phosphor layer is colored with a colorant capable of absorbing at least a portion of stimulating rays for stimulating each stimulable phosphor contained in the phosphor layers to give stimulated emission. That is, the phosphor layer on the support side (the first phosphor layer) can be colored with a colorant capable of selectively absorbing the stimulating rays so as to absorb at least a portion of the stimulating rays advancing with spread towards the interface between the support and the phosphor layer, as well as at least a portion of the stimulating rays spread by reflection on the interface therebetween. Thus, further enhancement of the sharpness of the resulting image can be accomplished.

Representative embodiments of the radiation image storage panels of the present invention having the above-mentioned preferable characteristics will be described hereinbelow, by referring to FIG. 1.

In FIG. 1, each of (A) to (C) schematically shows a sectional view of the radiation image storage panel according to the present invention.

FIG. 1-(A) shows a radiation image storage panel comprising a support (a) , the first phosphor layer ($b_1$), the second phosphor layer ($b_2$) and a protective film (c), superposed in this order.

FIG. 1-(B) shows a radiation image storage panel comprising a support (a), the first phosphor layer ($b_1$), the second phosphor layer ($b_2$), another phosphor layer ($b_3$) and a protective film (c), superposed in this order.

FIG. 1-(C) shows a radiation image storage panel comprising a support (a), the first phosphor layer ($b_1$), another phosphor layer ($b_3$), the second phosphor layer ($b_2$) and a protective film (c), superposed in this order.

Each embodiment of (A), (B) and (C) in FIG. 1 shows a basic structure of radiation image storage panel, but the radiation image storage panel of the present invention is by no means restricted to the above-mentioned structures. For instance, radiation image storage panels having other various structures such as a panel provided with a subbing layer between optional layers can be included in the invention.

In FIG. 1, the radiation image storage panels comprising two or three phosphor layers are shown, but the radiation image storage panel of the present invention is by no means restricted to the panel having two or three phosphor layers. Further, the first phosphor layer may be so colored as described above.

A process for the preparation of the radiation image storage panel of the present invention having the above-mentioned structure will be described hereinafter, referring to the radiation image storage panel comprising two phosphor layers of the first phosphor layer and the second phosphor layer as shown in FIG. 1-(A).

The radiation image storage panels of the present invention can be prepared, for instance, in the following manner.

The support material employed in the present invention can be selected from those employed in the conventional radiogaphic intensifying screens or those employed in the known radiation image storage panels. Examples of the support material include plastic films such as films of cellulose acetate, polyester, polyethylene terephthalate, polyamide, polyimide, triacetate and polycarbonate; metal sheets such as aluminum foil and aluminum alloy foil; ordinary papers; baryta paper; resin-coated papers; pigment papers containing titanium dioxide or the like; and papers sized with polyvinyl alcohol or the like. From the viewpoint of characteristics of a radiation image storage panel as an information recording material, a plastic film is preferably employed as the support material of the invention. The plastic film may contain a light-absorbing material such as carbon black, or may contain a light-reflecting material such as titanium dioxide. The former is appropriate for preparing a high-sharpness type radiation image storage panel, while the latter is appropriate for preparing a high-sensitivity type radiation image storage panel.

In the preparation of a known radiation image storage panel, one or more additional layers are occasionally provided between the support and the phosphor layer so as to enhance the bonding strength between the support and the phosphor layer, or to improve the sensitivity of the panel or the quality of an image provided thereby. For instance, a subbing layer or an adhesive layer may be provided by coating polymer material such as gelatin over the surface of the support on the phosphor layer side. Otherwise, a light-reflecting layer or a light-absorbing layer may be provided by forming a polymer material layer containing a light-reflecting material such as titanium dioxide or a light-absorbing material such as carbon black. In the invention, one or more of these additional layers may be provided on the support.

As described in Japanese Patent Application No. 57(1982)-82431 (corresponding to U.S. patent application Ser. No. 496,278 and European Patent Publication No. 92241), the phosphor layer side surface of the support (or the surface of an adhesive layer, light-reflecting layer, or light-absorbing layer in the case where such layers provided on the phosphor layer) may be provided with protruded and depressed portions for enhancement of the sharpness of radiographic image.

On the support prepared as described above, phosphor layers are formed. The phosphor layer comprises a binder and stimulable phosphor particles dispersed therein. In the present invention, as descrived hereinbefore, the phosphor layers comprise at least two layers, namely the first phosphor layer and the second phosphor layer.

The stimulable phosphor, as described hereinbefore, gives stimulated emission when excited with stimulating rays after exposure to a radiation. From the viewpoint of practical use, the stimulable phosphor is desired to give stimulated emission in the wavelength region of 300–500 nm when excited with stimulating rays in the wavelength region of 400–850 nm.

Examples of the stimulable phosphor employable in the radiation image storage panel of the present invention include:

SrS:Ce,Sm, SrS:Eu,Sm, $ThO_2$:Er, and $La_2O_2S$:Eu,Sm, as described in U.S. Pat. No. 3,859,527;

ZnS:Cu,Pb, $BaO.xAl_2O_3$:Eu, in which x is a number satisfying the condition of $0.8 \leqq x \leqq 10$, and $M^{2+}O.xSiO_2$:A, in which $M^{2+}$ is at least one divalent metal selected from the group consisting of Mg, Ca, Sr, Zn, Cd and Ba, A is at least one element selected from the group consisting of Ce, Tb, Eu, Tm, Pb, Tl, Bi and Mn, and x is a number satisfying the condition of $0.5 \leqq x \leqq 2.5$, as described in U.S. Pat. No. 4,326,078;

$(Ba_{1-x-y},Mg_x,Ca_y)FX:aEu^{2+}$, in which X is at least one element selected from the group consisting of Cl and Br, x and y are numbers satisfying the conditions of $0<x+y \leqq 0.6$, and $xy \neq 0$, and a is a number satisfying the condition of $10^{-6} \leqq a \leqq 5 \times 10^{-2}$, as described in Japanese Patent Provisional Publication No. 55(1980)-12143;

LnOX:xA, in which Ln is at least one element selected from the group consisting of La, Y, Gd and Lu, X is at least one element selected from the group consisting of Cl and Br, A is at least one element selected from the group consisting of Ce and Tb, and x is a number satisfying the condition of $0<x<0.1$, as described in the above-mentioned U.S. Pat. No. 4,236,078;

$(Ba_{1-x},M^{II}_x)FX:yA$, in which $M^{II}$ is at least one divalent metal selected from the group consisting of Mg, Ca, Sr, Zn and Cd, X is at least one element selected from the group consisting of Cl, Br and I, A is at least one element selected from the group consisting of Eu, Tb, Ce, Tm, Dy, Pr, Ho, Nd, Yb and Er, and x and y are numbers satisfying the conditions of $0 \leqq x \leqq 0.6$ and $0 \leqq y \leqq 0.2$, respectively, as described in Japanese Patent Provisional Publication No. 55(1980)-12145;

The above-described stimulable phosphors are given by no means to restrict the stimulable phosphor employable in the present invention. Any other phosphors can be also employed, provided that the phosphor gives stimulated emission when excited with stimulating rays after exposure to a radiation.

Examples of the binder to be contained in the phosphor layer include: natural polymers such as proteins (e.g. gelatin), polysaccharides (e.g. dextran) and gum arabic; and synthetic polymers such as polyvinyl butyral, polyvinyl acetate, nitrocellulose, ethylcellulose, vinylidene chloride-vinyl chloride copolymer, polymethyl methacrylate, vinyl chloride-vinyl acetate copoymer, polyurethane, cellulose acetate butyrate, polyvinyl alcohol, and linear polyester. Particularly preferred are nitrocellulose, linear polyester, and a mixture of nitrocellulose and linear polyester.

The first phosphor layer can be formed on the support, for instance, by the following procedure.

In the first place, stimulable phosphor particles and a binder with a certain mixing ratio are added to an appropriate solvent, and then they are mixed to prepare a coating dispersion of the phosphor particles in the binder solution.

Examples of the solvent employable in the preparation of the coating dispersion include lower alcohols such as methanol, ethanol, n-propanol and n-butanol; chlorinated hydrocarbons such as methylene chloride and ethylene chloride; ketones such as acetone, methyl ethyl ketone and methyl isobutyl ketone; esters of lower alcohols with lower aliphatic acids such as methyl acetate, ethyl acetate and butyl acetate; ethers such as dioxane, ethylene glycol monoethylether and ethylene glycol monoethyl ether; and mixtures of the above-mentioned compounds.

The mixing ratio of the binder to the stimulable phosphor in the coating dispersion can be determined according to the characteristics of the aimed radiation image storage panel and the nature of the phosphor employed. Generally, the ratio is within the range of from 1:1 to 1:100 (binder:phosphor, by weight), preferably from 1:8 to 1:40.

However, in order to enhance the bonding strength between the support and the phosphor layer, it is required in the invention that the ratio of the binder to the stimulable phosphor in the coating dispersion for the first phosphor layer is larger than the same ratio in the coating dispersion for the second phosphor layer.

The coating dispersion may contain a dispersing agent to improve the dispersibility of the phosphor particles therein, and may contain a variety of additives such as a plasticizer for increasing the bonding between the binder and the phosphor particles in the phosphor layer. Examples of the dispersing agent include phthalic acid, stearic acid, caproic acid and a hydrophobic surface active agent. Examples of the plasticizer include phosphates such as triphenyl phosphate, tricresyl phosphate and diphenyl phosphate; phthalates such as diethyl phthalate and dimethoxyethyl phthalate; glycolates such as ethylphthalyl ethyl glycolate and butylphthalyl butyl glycolate; and polyesters of polyethylene glycols with aliphatic dicarboxylic acids such as polyester of triethylene glycol with adipic acid and polyester of diethylene glycol with succinic acid.

The coating dispersion containing the phosphor particles and the binder prepared as described above is applied evenly onto the surface of a support to form a layer of the coating dispersion. The coating procedure can be carried out by a conventional method such as a method using a doctor blade, a roll coater or a knife coater.

After applying the coating dispersion onto the support, the coating dispersion is then heated slowly to dryness so as to complete the formation of the first phosphor layer. The thickness of the first phosphor layer varies depending upon the characteristics of the aimed radiation image storage panel, the nature of the phosphor, the ratio of the binder to the phosphor, etc. In general, the thickness of the first phosphor layer is within a range of from 20 to 500 μm.

The first phosphor layer is preferred to have a smaller thickness within the limits of not affecting the resulting bonding strength, and the thickness thereof preferably ranges from 20 to 200 μm, since the main purpose of providing the first phosphor layer is enhancement of the bonding strength between the phosphor layer and the support.

The first phosphor layer can be provided onto the support by the methods other than that given in the above. For instance, the phosphor layer is initially prepared on a sheet material (false support) such as a glass plate, a metal plate or a plastic sheet using the aforementioned coating dispersion and then thus prepared phosphor layer is superposed on the genuine support by pressing or using an adhesive agent.

From the viewpoint of the sharpness of the image provided by the panel, as described above, the first phosphor layer may be colored with a colorant capable of selectively absorbing the stimulating rays to be applied to the panel.

The colorant employable in the radiation image storage panel of the present invention is preferred to have the absorption characteristics that the mean absorption coefficient thereof in the wavelength region of the stimulating rays for the stimulable phosphors (which are contained in the phosphor layers including at least two layers, namely the first and second phosphor layers) is higher than the mean absorption coefficient thereof in the wavelength region of the light emitted by said stimulable phosphors upon stimulation thereof. From the viewpoint of the sharpness of the image provided by the panel, it is desired that the mean absorption coefficient of the colorant in the wavelength region of the stimulating rays for the stimulable phosphors is as high as possible. On the other hand, from the viewpoint of the sensitivity of the panel, it is desired that the mean absorption coefficient of the colorant in the wavelength region of the light emitted by said stimulable phosphors upon stimulation thereof is as low as possible.

Accordingly, the preferred colorant depends on the stimulable phosphors employed in the radiation image storage panel. From the viewpoint of practical use, the stimulable phosphor is desired to give stimulated emission in the wavelength region of 300–500 nm when excited with stimulating rays in the wavelength region of 400–850 nm as described above. Employable for such a stimulable phosphor is a colorant having a body color ranging from blue to green so that the mean absorption coefficient thereof in the wavelength region of the stimulating rays for the phosphors is higher than the mean absorption coefficient thereof in the wavelength region of the light emitted by the phosphors upon stimulation and that the difference therebetween is as large as possible.

The colorant preferably employed in the invention is an organic colorant or an inorganic colorant having a body color ranging from blue to green and is disclosed, for example, in Japanese Patent Provisional Publication No. 55(1980)-163500 (corresponding to U.S. Pat. No. 4,394,581 and European Patent Publication No. 21174) and Japanese Patent Provisional Publication No. 57(1982)-96300 (corresponding to U.S. Patent application Ser. No. 326,642).

Subsequently, on the first phosphor layer is formed the second phosphor layer.

The second phosphor layer is formed in the same manner as described above, employing the aforementioned stimulable phosphor, binder and solvent, and various additives such as a dispersing agent and a plasticizer can be also optionally added. Accordingly, there is no specific limitation on the kind of stimulable phosphor, binder, solvent or the like employable for the formation of the second phosphor layer, and they may be the same or different from those employed for the formation of the first phosphor layer.

However, from the viewpoint of the sharpness of the image provided by the resulting radiation image storage panel, the mixing ratio of the binder to the stimulable phosphor in the second phosphor layer is required to be larger than the mixing ratio of the binder to the stimulable phosphor in the first phosphor layer as described hereinbefore. The mixing ratio of the binder to the stimulable phosphor in the coating dispersion for the formation of the second phosphor layer is preferably within the range of from 1:10 to 1:80, by weight.

From the same viewpoint, the thickness of the second phosphor layer is desired to be not less than 50% of the total thickness of phosphor layers including the thickness of the first and sencond phosphor layers, and the thickness of the second phosphor layer is preferably within the range of from 50 to 500 μm. The total thickness of the phosphor layers comprising the first and second phosphor layers is within the range of from 50 μm to 1 mm and preferably from 100 to 500 μm.

When the second phosphor layer is formed directly on the first phosphor layer through a coating procedure, the binder and solvent employed for the formation of the second phosphor layer are preferably different from those employed for the formation of the first phosphor layer so as not to dissolve the surface of the previously formed first phosphor layer.

The plural phosphor layers can be formed on the support, for instance, by procedures of simulataneous coating and forming of the two layers, as well as by the procedure of the above-described successive coating and forming of the first phosphor layer and second phosphor layer in this order.

According to the process for the preparation as described above, a radiation image storage panel of the present invention comprising a support, the first phosphor layer and the second phosphor layer can be prepared.

The radiation image storage panel of the present invention is not restricted to the above-mentioned panel having two phosphor layers, and the panel may have three or more of phosphor layers. In the case of providing three or more of phosphor layers, the phosphor layer(s) other than the first and second phosphor layers can be formed employing the aforementioned stimulable phosphor, binder and solvent in an appropriate mixing ratio, although it is desired that the total thickness of phosphor layers is within the above-mentioned range and the thickness of the second phoshor layer is not less than 50% of said total thickness. The radiation image storage panel having three or more phosphor layers can be prepared in the same manner as described above.

The radiation image storage panel generally has a transparent film on a free surface of a phosphor layer to protect the phosphor layer from physical and chemical deterioration. In the radiation image storage panel of the present invention, it is preferable to provide a transparent film for the same purpose.

The transparent film can be provided onto the phosphor layer by coating the surface of the phosphor layer with a solution of a transparent polymer such as a cellulose derivative (e.g. cellulose acetate or nitrocellulose), or a synthetic polymer (e.g. polymethyl methacrylate, polyvinyl butyral, polyvinyl formal, polycarbonate, polyvinyl acetate, or vinyl chloride-vinyl acetate copolymer), and drying the coated solution. Alternatively, the transparent film can be provided onto the phosphor layer by beforehand preparing it from a polymer such as polyethylene terephthalate, polyethylene, polyvinylidene chloride or polyamide, followed by placing and fixing it onto the phosphor layer with an appropriate adhesive agent. The transparent protective film preferably has a thickness within a range of approx. 3 to 20 μm.

The following examples further illustrate the present invention, but these examples are by no means understood to restrict the invention.

EXAMPLES 1

To a mixture of a particulate divalent europium activated barium fluorobromide phosphor ($BaFBr:Eu^{2+}$) and polyurethane were added toluene and ethanol to prepare a dispersion containing the binder and the phosphor particles in the ratio of 1:10 (binder:phosphor, by weight). Subsequently, tricresyl phosphate was added to the dispersion and the mixture was sufficiently stirred by means of a propeller agitater to obtain a homogeneous coating dispersion having a viscosity of 25–35 PS (at 25° C.).

Then the coating dispersion was applied onto a polyethylene terephthalate sheet containing carbon black (support, thickness: 250 μm) placed horizontally on a glass plate. The application of the coating dispersion was carried out using a doctor blade. After the coating was complete, the support having the coating dispersion was placed in an oven and heated at a temperature gradually rising from 25° to 100° C. Thus, a phosphor layer (first phosphor layer) having the thickness of approx. 100 μm was formed on the support.

Independently, to a mixture of a particulate divalent europium activated barium fluorobromide phosphor and a linear polyester resin were added successively methyl ethyl ketone and nitrocellulose (nitrification degree: 11.5%), to prepare a dispersion containing the binder and the phosphor particles in the ratio of 1:20 (binder:phosphor, by weight). Subsequently, tricresyl phosphate, n-butanol and methyl ethyl ketone were added to the dispersion. The mixture was sufficiently stirred by means of a propeller agitater to obtain a homogeneous coating dispersion having a viscosity of 25–35 PS (at 25° C.).

The coating dispersion was applied onto the previously formed first phosphor layer in the same manner as described above to form a phosphor layer (second phosphor described above to form a phosphor layer (second phosphor layer) having the thickness of approx. 200 μm.

On the second phosphor layer was placed a polyethylene terephthalate transparent film (thickness: 12 μm; provided with a polyester adhesive layer on one surface) to combine the film and the second phosphor layer with the adhesive layer. Thus, a radiation image storage panel consisting essentially of a support, the first phosphor layer, the second phosphor layer and transparent protective film was prepared.

EXAMPLE 2

The radiation image storage panel consisting essentially of a support, the first phosphor layer, the second phosphor layer and a transparent protective film was prepared in the same manner as described in Example 1, except that the mixing ratio between the binder and the phosphor in the second phosphor layer was 1:40 (binder:phosphor, by weight).

COMPARISON EXAMPLE 1

The radiation image storage panel consisting essentially of a support, a phosphor layer and a transparent protective film was prepared in the same manner as described in Example 1, except that the thickness of the phosphor layer (first phosphor layer) was approx. 300 μm and the second phosphor layer was not provided on the first phosphor layer.

COMPARISON EXAMPLE 2

The radiation image storage panel consisting essentially of a support, a phosphor layer and a transparent protective film was prepared in the same manner as described in Example 1, except that the first phosphor layer was not provided and the phosphor layer (second phosphor layer) with a thickness of approx. 300 μm was directly formed on the support.

COMPARISON EXAMPLE 3

The radiation image storage panel consisting essentially of a support, a phosphor layer and a transparent protective film was prepared in the same manner as described in Example 2, except that the first phosphor layer was not provided and the phosphor layer (second phosphor layer) with a thickness of approx. 300 μm was directly formed on the support.

The radiation image storage panels prepared as described above were evaluated on the sharpness of the image provided thereby and the bonding strength between the phosphor layer and the support according to the following test.

(1) Sharpness of image

The radiation image storage panel was exposed to X-rays at voltage of 80 KVp through an MTF chart and subsequently scanned with a He-Ne laser beam (wavelength: 632.8 nm) to excite the phosphor particles contained in the panel. The light emitted by the phosphor layer(s) of the panel was detected and converted to electric signals by means of a photosensor (a photomultiplier having spectral sensitivity of type S-5). The electric signals were reproduced by an image reproducing apparatus to obtain a radiation image of the MTF chart as a visible image on a displaying apparatus, and the modulation transfer function (MTF) value of the visible image was determined. The MTF value was given as a value (%) at the spacial frequency of 2 cycle/mm.

(2) Bonding strength between phosphor layer and support

The radiation image storage panel was cut to give a test strip having a width of 10 cm and the test strip was given with a notch on the interface between the phosphor layer(s) and the support. In a tensile testing machine (Tensilon UTM-II-20 manufactured by Toyo Balodwin Co., Ltd., Japan), the support part and the part of the phosphor layer(s) and the protective film of the so notched test strip were forced to separate from each otehr by pulling both parts along the rectangular direction (peel angle: 90°) at a tensile rate of 10 mm/min. The bonding strength was determined just when a portion of the phosphor layer(s) in the length of 10-mm was separated from the support. The strength (peel strength) is expressed in terms of the force F (g/cm).

The so evaluated radiation image storage panels have one or two phosphor layers respectively as set forth in Table 1.

TABLE 1

| | 1st Phosphor Layer B:P (Thickness) | 2nd Phosphor Layer B:P (Thickness) |
|---|---|---|
| Example 1 | 1:10 (100) | 1:20 (200) |
| Example 2 | 1:10 (100) | 1:40 (200) |
| Com. Example 1 | 1:10 (300) | |
| Com. Example 2 | 1:20 (300) | |
| Com. Example 3 | 1:40 (300) | |

Notes:
B:P means a mixing ratio by weight of the binder to the stimulable phosphor and the thickness of the phosphor layer is expressed in terms of μm.

The results of the evaluation on the radiation image storage panels are set forth in Table 2. The sensitivity of the panels is also set forth in Table 2.

TABLE 2

| | Sharpness (%) | Bonding Strength (g/cm) | Relative Sensitivity |
|---|---|---|---|
| Example 1 | 30 | 250 | 100 |
| Example 2 | 33 | 230 | 102 |
| Com. Example 1 | 26 | 280 | 100 |
| Com. Example 2 | 30 | 80 | 102 |
| Com. Example 3 | 33 | 30 | 101 |

We claim:

1. A radiation image storage panel comprising a support and phosphor layers provided thereon, each of said phosphor layers comprising a binder and a stimulable phosphor dispersed therein, wherein said phosphor layers comprise a first phosphor layer provided on the support and a second phosphor layer provided on the side nearer to the front surface of the panel than said first phosphor layer, and the mixing ratio of the binder to the stimulable phosphor in the first phosphor layer is larger than the mixing ratio of the binder to the stimulable phosphor in the second phosphor layer.

2. The radiation image storage panel as claimed in claim 1, in which the thickness of the second phosphor layer is not less than 50% of the total thickness of the phosphor layers.

3. The radiation image storage panel as claimed in claim 1, in which the stimulable phosphor contained in the first phosphor layer is essentially the same as the stimulable phosphor contained in the second phosphor layer.

4. The radiation image storage panel as claimed in claim 1, in which the phosphor layers consist of said first phosphor layer and said second phosphor layer provided on said first phosphor layer.

5. The radiation image storage panel as claimed in claim 1, in which the total thickness of the phosphor layers is within the range of from 50 um to 1 mm.

6. The radiation image storage panel as claimed in claim 1, in which at least one of the phosphor layers contains a divalent europium activated alkaline earth metal fluorohalide phosphor.

7. The radiation image storage panel as claimed in claim 6, in which both of the first phosphor layer and the second phosphor layer contain a divalent europium activated alkaline earth metal fluorohalide phosphor.

8. The radiation image storage panel as claimed in any one of claims 1 through 7, in which the first phosphor layer is colored with a colorant capable of absorbing at least a portion of stimulating rays for the stimulable phosphors contained in the phosphor layers.

9. The radiation image storage panel as claimed in claim 8, in which the first phosphor layer is colored with a colorant whose mean absorption coefficient in the wavelength region of the stimulating rays for the stimulable phosphors contained in the phosphor layers is higher than the mean absorption coefficient of said colorant in the wavelength region of the light emitted by the stimulable phosphors upon stimulation thereof.

* * * * *